US006313797B1

(12) United States Patent
Kurita et al.

(10) Patent No.: US 6,313,797 B1
(45) Date of Patent: Nov. 6, 2001

(54) DIELECTRIC ANTENNA INCLUDING FILTER, DIELECTRIC ANTENNA INCLUDING DUPLEXER, AND RADIO APPARATUS

(75) Inventors: Junichi Kurita; Hideyuki Kato, both of Ishikawa-ken; Yuichi Kushihi, Kanazawa; Motoharu Hiroshima, Ishikawa-ken; Jinsei Ishihara; Haruo Matsumoto, both of Kanazawa, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/426,551

(22) Filed: Oct. 22, 1999

(30) Foreign Application Priority Data

Oct. 22, 1998 (JP) ..... 10-300756

(51) Int. Cl.[7] ..... H01Q 1/38
(52) U.S. Cl. ..... 343/700 MS; 333/202 DB
(58) Field of Search ..... 343/700 MS, 202, 343/206, 206 DB; 333/202 DB, 134, 126, 129, 202, 206, 222

(56) References Cited

U.S. PATENT DOCUMENTS

| | | | | |
|---|---|---|---|---|
| 5,483,678 | | 1/1996 | Abe | 455/80 |
| 5,684,492 | | 11/1997 | Kagoshima et al. | 343/700 MS |
| 5,686,873 | * | 11/1997 | Tada et al. | 333/134 |
| 5,714,961 | | 2/1998 | Kot et al. | 343/769 |
| 6,002,306 | * | 12/1999 | Arakawa | 333/134 |
| 6,002,307 | * | 12/1999 | Arakawa | 333/135 |
| 6,087,909 | * | 7/2000 | Toda et al. | 333/134 |
| 6,122,489 | * | 9/2000 | Yorita | 455/83 |

FOREIGN PATENT DOCUMENTS

| | | | |
|---|---|---|---|
| 0364931 | * | 10/1989 | (EP) . |
| 0738023 | | 10/1996 | (EP) . |
| 6-140807 | * | 10/1992 | (JP) . |
| 6-164206 | * | 6/1993 | (JP) . |
| 5145316 | | 6/1993 | (JP) . |
| WO 92/20163 | * | 11/1992 | (WO) . |

OTHER PUBLICATIONS

Patent Abstracts Of Japan, vol. 17, No. 528 (E–1437) Sep. 22, 1993 & JP 05 145316 A (Mitsubishi Electric), Jun. 11, 1993, abstract.

* cited by examiner

*Primary Examiner*—Don Wong
*Assistant Examiner*—Trinh Vo Dinh

(57) ABSTRACT

A dielectric antenna including a filter, comprising: a dielectric substrate; an antenna portion, comprising a radiation electrode having one short-circuited end and one open end and provided on or within the dielectric substrate; a filter portion comprising; at least one resonance electrode provided on or within the dielectric substrate, and a external coupling electrode in association with the resonance electrode; and the radiation electrode and the resonance electrode being coupled to each other.

15 Claims, 7 Drawing Sheets

FIG. 3A
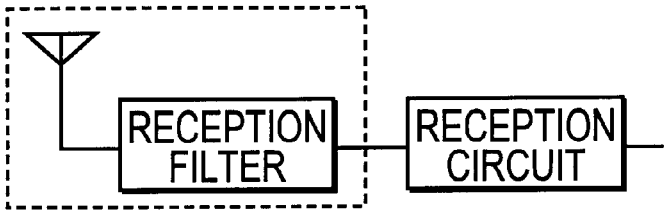
FIG. 3B
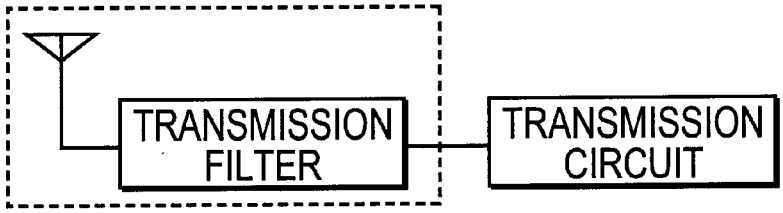
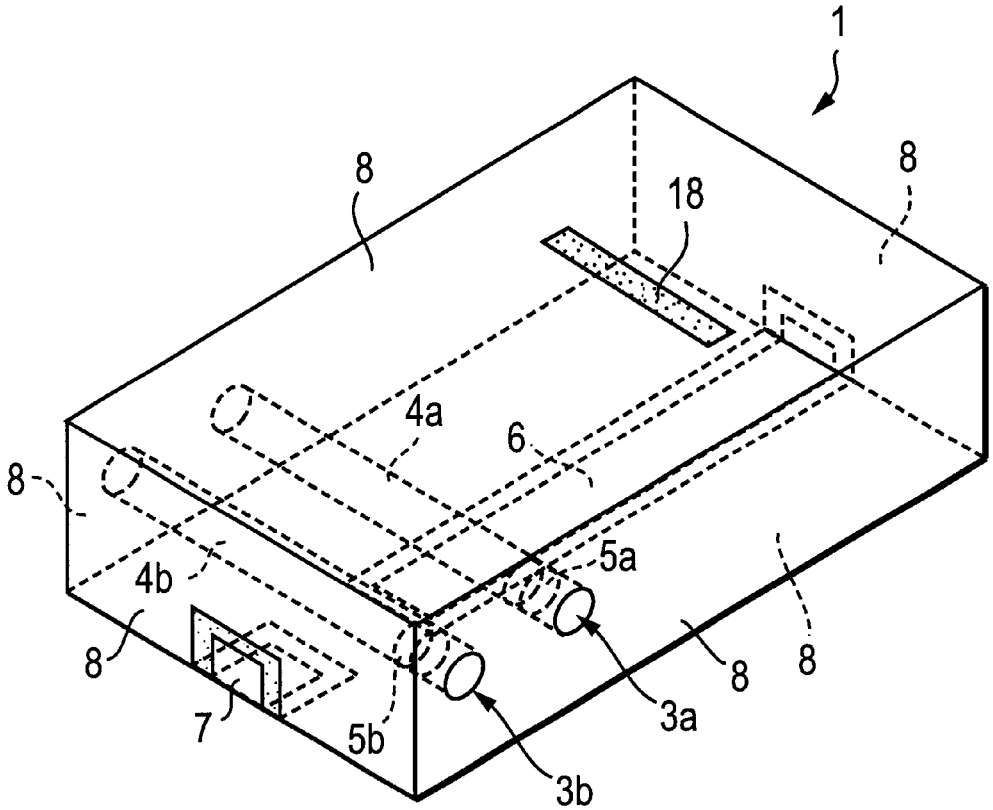
FIG. 4

FIG. 10A
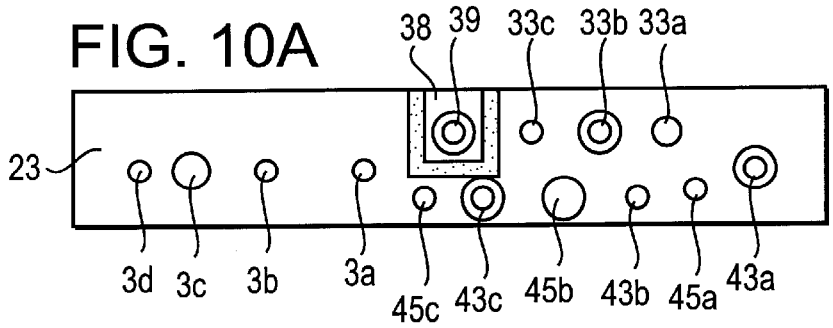
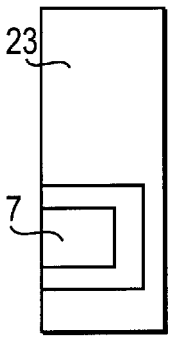
FIG. 10D
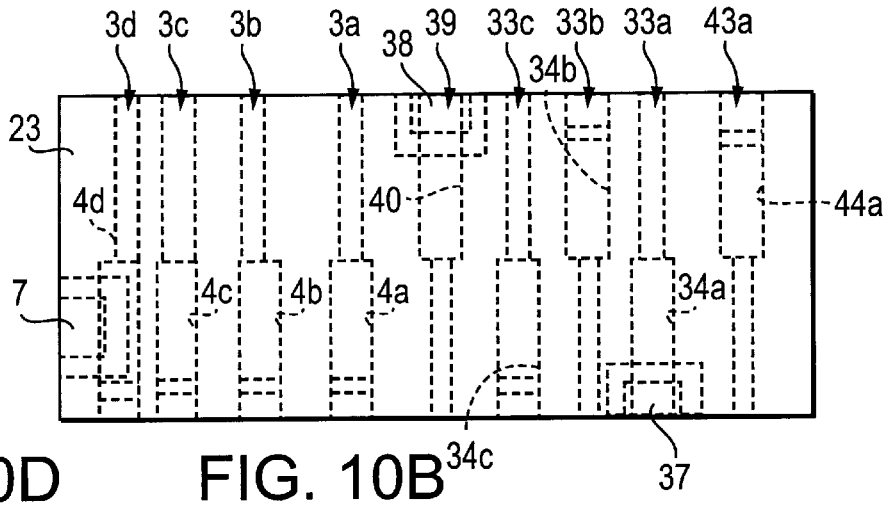
FIG. 10B
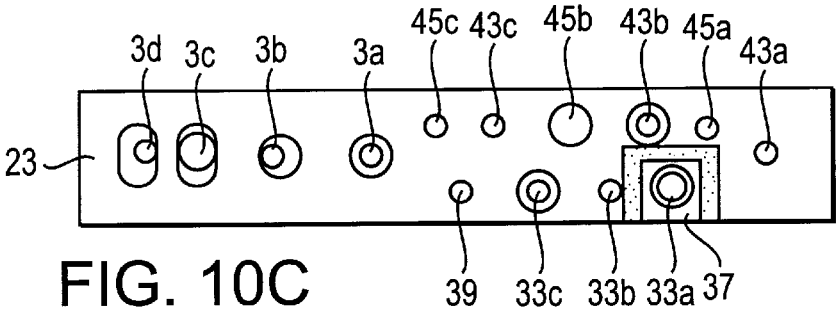
FIG. 10C
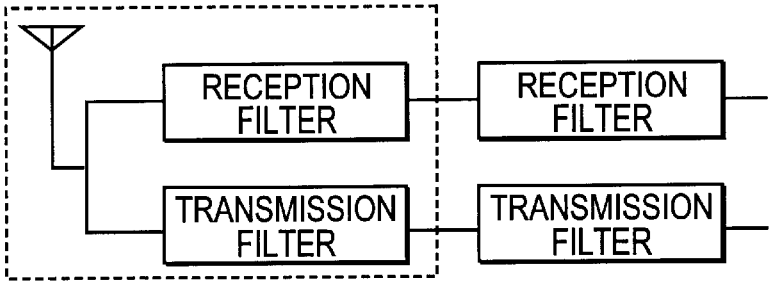
FIG. 11

DIELECTRIC ANTENNA INCLUDING FILTER, DIELECTRIC ANTENNA INCLUDING DUPLEXER, AND RADIO APPARATUS

BACKGROUND OF THE INVENTION

1. Field of the Invention

The present invention relates to a dielectric antenna having a filter function, a dielectric antenna having a duplexer function, and a radio apparatus using these.

2. Description of the Related Art

A microstrip antenna and a dielectric antenna have been used as an antenna in the microwave band, especially one suitable for a small-scale radio apparatus.

Furthermore, in general a reception filter is provided in order to extract a desired frequency signal from received waves, and a transmission filter is used to transmit only the desired frequency signal as a transmission wave. An antenna in which such filters are provided in the antenna portion to enable the entire device to be miniaturized is disclosed in Japan Unexamined Patent Publication No. 8-181533.

The above described microstrip antenna having a filter function comprises a microstrip antenna, the microstrip antenna comprising a ground conductor and a microstrip conductor provided on a dielectric substrate. And a dielectric resonator is constituted on the dielectric substrate. By this arrangement, the microstrip antenna and the dielectric filter can be provided on a single dielectric substrate. However, since the antenna portion and the filter portion are independent of each other, transmitting means must be separately provided in order to input the receive signal to the filter portion, and loss occurs in this part. This causes deterioration in the electrical characteristics.

SUMMARY OF THE INVENTION

To overcome the above described problems, preferred embodiments of the present invention provide a dielectric antenna including a filter and a dielectric antenna including a duplexer, wherein loss problems caused when transmission means (a waveguide) is provided between the antenna portion and the filter portion are eliminated, and which are miniaturized and have excellent electrical characteristics, and a radio apparatus using these.

One preferred embodiment of the present invention provides a dielectric antenna including a filter, comprising: a dielectric substrate; an antenna portion comprising; a radiation electrode having one short-circuited end and one open end and provided on or within the dielectric substrate; a filter portion comprising; at least one resonance electrode provided on or within the dielectric substrate, and a external coupling electrode in association with the resonance electrode; and the radiation electrode and the resonance electrode being coupled to each other.

In the above described dielectric antenna including a filter, an electrode electrically isolated from ground and which generates a static capacitance between the resonance electrode and the radiation electrode may be provided; and the resonance electrode and the radiation electrode may be coupled to each other by static capacitance.

Another preferred embodiment of the present invention provides a dielectric antenna including a filter, comprising: a dielectric substrate; a slot antenna-type antenna portion comprising; a ground electrode opened in a slot shape and provided on a dielectric substrate; a filter portion comprising; at least one resonance electrode provided on or within the dielectric substrate, and a external coupling electrode in association with the resonance electrode; and an electrode coupled to the resonance electrode and coupled to the slot antenna.

According to the above described structures and arrangements, since an antenna portion is provided on or within a dielectric substrate, and in addition, one or multiple resonance electrodes are provided to form a filter portion, and the resonance electrodes and the antenna portion are coupled, there is no need to provide a special transmission guide or the like to connect the antenna portion and the filter portion, and consequently a dielectric antenna including a filter with no transmission guide loss and excellent electrical characteristics can be formed.

Yet another preferred embodiment of the present invention provides a dielectric antenna including a filter, comprising: a first dielectric substrate; an antenna portion comprising: a predetermined shaped electrode which comprises an external coupling electrode and provided on or within the first dielectric substrate; a second dielectric substrate;

a filter portion comprising; at least one resonance electrode provided on or within the second dielectric substrate, and an external coupling electrode in association with the resonance electrode; and a substrate on which an electrode connecting the external coupling electrode of the antenna portion and the external coupling electrode of the filter portion are disposed and the antenna portion and the filter portion are mounted.

With this constitution, as regards the antenna portion and the filter portion, the material, dimensions, electrode pattern, and the like of the dielectric substrate can be designed with maximum suitability. In addition, a single-body dielectric antenna including a filter, which is a unified component capable of being mounted on a mount substrate, can be obtained.

Furthermore, yet another preferred embodiment of the present invention provides a dielectric antenna including a duplexer, comprising: a transmission filter and a reception filter, each comprising the above described filter portion; and the resonance electrode of an output stage of the transmission filter and the resonance electrode of an input stage of the reception filter being coupled to an antenna portion.

When the antenna is used for transmission in this way, by providing the duplexer portion and the antenna portion together, the high-frequency circuit portion can be miniaturized even further.

Moreover, yet another preferred embodiment of the present invention provides a radio apparatus comprising the above described dielectric antenna including a filter, or the above described dielectric antenna including a duplexer, as a high-frequency circuit portion.

As a consequence, it is possible to achieve a radio apparatus which has a high-frequency circuit portion of excellent characteristics, and which is entirely miniaturized.

Other features and advantages of the present invention will become apparent from the following description of the invention which refers to the accompanying drawings.

BRIEF DESCRIPTION OF DRAWINGS

FIG. 3A and FIG. 3B are block diagrams showing a constitution of a radio apparatus according to a second embodiment.

FIG. 4 is a perspective view of a dielectric antenna including a filter according to a third embodiment.

FIG. 10 is a projected view of a filter portion in the same dielectric antenna including a duplexer.

FIG. 11 is a block diagram showing a constitution of a radio apparatus comprising a dielectric antenna including a duplexer.

PREFERRED EMBODIMENTS OF THE PRESENT INVENTION

The constitution of a dielectric antenna including a filter according to a first preferred embodiment of this invention will be explained with reference to FIG. 1 and FIG. 2.

Figure 1:
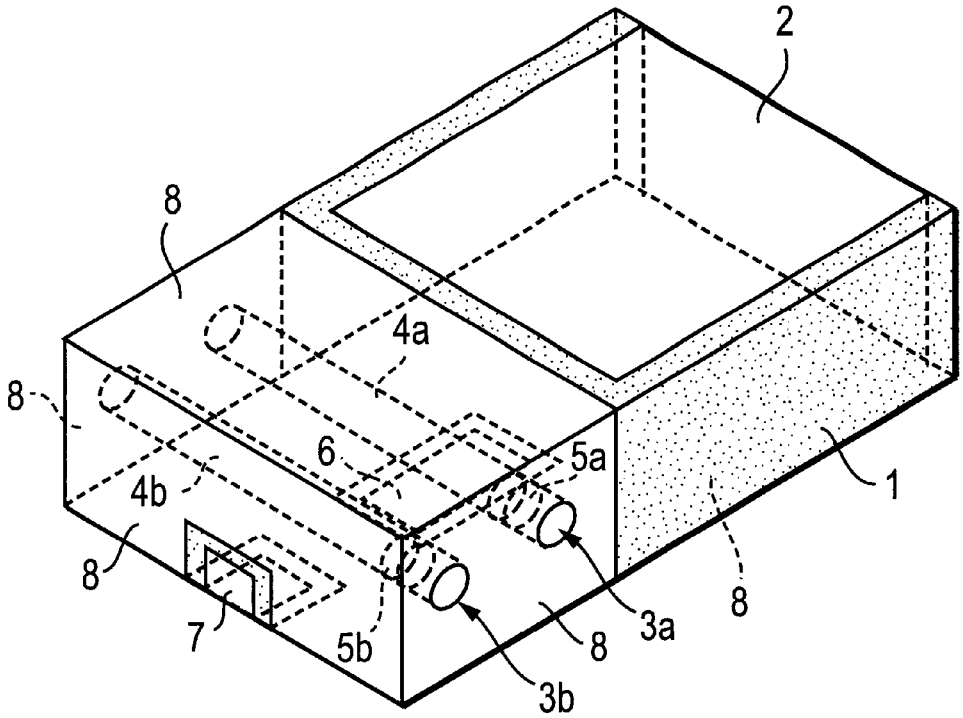
FIG. 1 is a perspective view of a dielectric antenna including a filter according to a first embodiment.

FIG. 1 is a perspective view of a dielectric antenna including a filter. In FIG. 1, a numeral 1 represents a rectangular dielectric substrate, a ground electrode 8 is provided at the bottom face in the diagram, and a radiation electrode 2 is provided on the right rear end face in the diagram of the dielectric substrate 1 and on the top face in the diagram. This portion comprises a $\lambda/4$ resonating-type dielectric antenna having one short-circuited end and one open end. Furthermore, through holes 3*a* and 3*b* are provided in the dielectric substrate 1, and resonance electrodes 4*a* and 4*b* are provided inside these through holes. Ground electrodes 8 are provided at the two open faces of these through holes 3*a* and 3*b*, the top and bottom faces, and the left front end face, as viewed in the diagram. One end of each of the resonance electrodes 4*a* and 4*b* leads to the ground electrodes 8 at the open faces of the through holes 3*a* and 3*b*, and the other end portions are open at where no electrodes are formed, i.e., nonconductive portions 5*a* and 5*b*. An electrode 6 is provided in the lower side of the diagram of the dielectric substrate 1, and is isolated (electrically floated) from the ground electrodes 8. An electrode for external coupling 7 is provided extending from the lower side of the diagram of the dielectric substrate 1 to the front end face. The electrode 6 and the resonance electrode 4*a* are coupled by static capacitance created therebetween. Furthermore, the electrode for external coupling 7 and the resonance electrode 4*b* are coupled by static capacitance generated therebetween. Moreover, the electrode 6 and the radiation electrode 2 are coupled by static capacitance created between the electrode 6 and the area near the open end of the radiation electrode 2.

Figure 2:
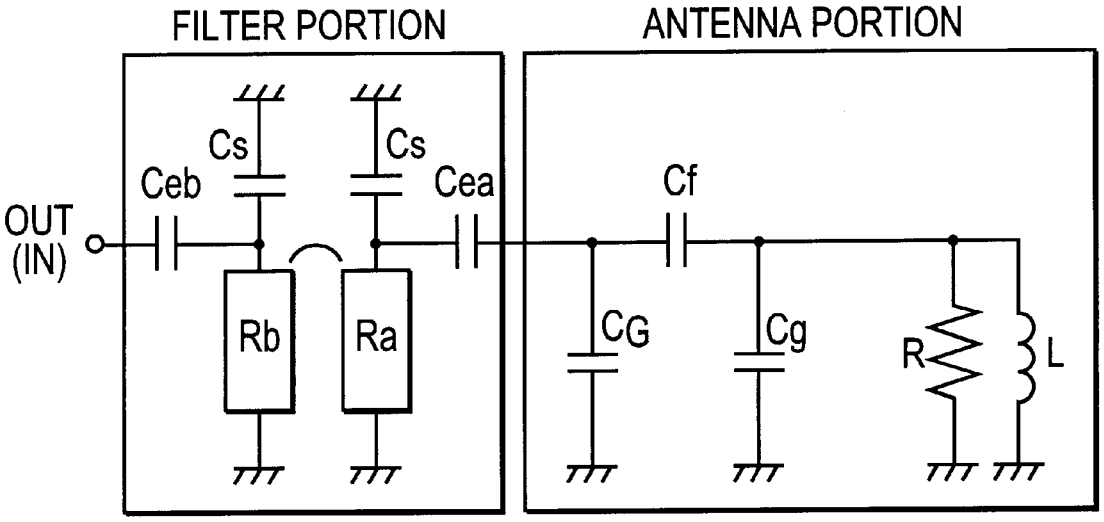
FIG. 2 is an equivalent circuit diagram of the same dielectric antenna including a filter.

FIG. 2 is an equivalent circuit diagram of the dielectric antenna including a filter shown in FIG. 1. In FIG. 2, numerals Ra and Rb represent resonators (coaxial resonators) using the resonance electrodes 4*a* and 4*b* in FIG. 1, and these two resonators Ra and Rb are comb-line coupled. Numerals Cs represent stray capacitances created in the nonconductive portions 5*a* and 5*b*. Cea represents a static capacitance created between the resonance electrode 4*a* and the electrode 6, and Ceb is a static capacitance created between the resonance electrode 4*b* and the electrode for external coupling 7. This constitution forms a filter portion comprising two resonator stages, and exhibiting bandpass filter pass characteristics.

Furthermore, in FIG. 2, a numeral Cf represents static capacitance created between the electrode 6 and the open end of the radiation electrode 2, a numeral Cg represents static capacitance created between the open end of the radiation electrode 2 and the ground electrode 8, and a numeral CG represents static capacitance created between the electrode 6 and the ground electrode 8. L represents the inductance component of the radiation electrode 2, and this induction component and mainly Cg form a resonant circuit. A numeral R represents radiation resistance. The above circuit portions comprise an antenna portion.

According to the constitution shown above, by making the characteristics of the filter portion bandpass filter characteristics which pass only signals in the receive signal frequency band, it is possible to obtain only the desired received signal from the electrode for external coupling 7 shown in FIG. 1, merely by mounting this dielectric antenna including a filter on a circuit substrate.

Next, a constitution of a radio apparatus using a dielectric antenna including a filter, which is a second preferred embodiment, will be explained with reference to FIGS. 3A and 3B.

FIG. 3A is a block diagram of a receive portion of a radio apparatus, and FIG. 3B is a block diagram of a transmission portion of the radio apparatus. In FIGS. 3A and 3B, the alternate long and two short dash line portion represents the dielectric antenna including a filter. In FIG. 3A, a receive antenna is provided in a single structure with a reception filter, and in FIG. 3B, the transmission antenna is provided in a single structure with a transmission filter. This dielectric antenna including a filter is for instance mounted on a circuit substrate in a radio apparatus. Consequently, the entire radio apparatus can be miniaturized.

Next, FIG. 4 shows a perspective view of a constitution of a dielectric antenna including a filter according to a third preferred embodiment. Ground electrodes 8 are provided on the outer faces (six faces) of a rectangular dielectric substrate 1. A slot without a ground electrode is provided in the top side of the diagram of the dielectric substrate 1. This structure forms a slot antenna. Furthermore, through holes 3*a* and 3*b* are provided in the dielectric substrate 1, and resonance electrodes 4*a* and 4*b* are provided therein. Ends of each of the resonance electrodes 4*a* and 4*b* are led to the ground electrodes 8 in the open faces of the through holes 3*a* and 3*b*, and the other ends are open at the nonconductive portions 5*a* and 5*b*. An electrode 6 is provided from the bottom face of the dielectric substrate 1 to the right rear side in the diagram, and is isolated from the ground electrodes 8. Furthermore, an electrode for external coupling 7 is provided from the lower side of the dielectric substrate 1 to the left end face in the diagram, and is isolated from the ground electrodes 8. The electrode 6 and the electrode for external coupling 7, and the resonance electrodes 4*a* and 4*b*, are coupled by static capacitance created therebetween. Furthermore, the magnetic field of the electrode 6 causes electromagnetic field distribution, whereby an electrical field travels towards the direction of the short end of the slot 18, thereby supplying electricity to the above slot antenna.

Figure 5:
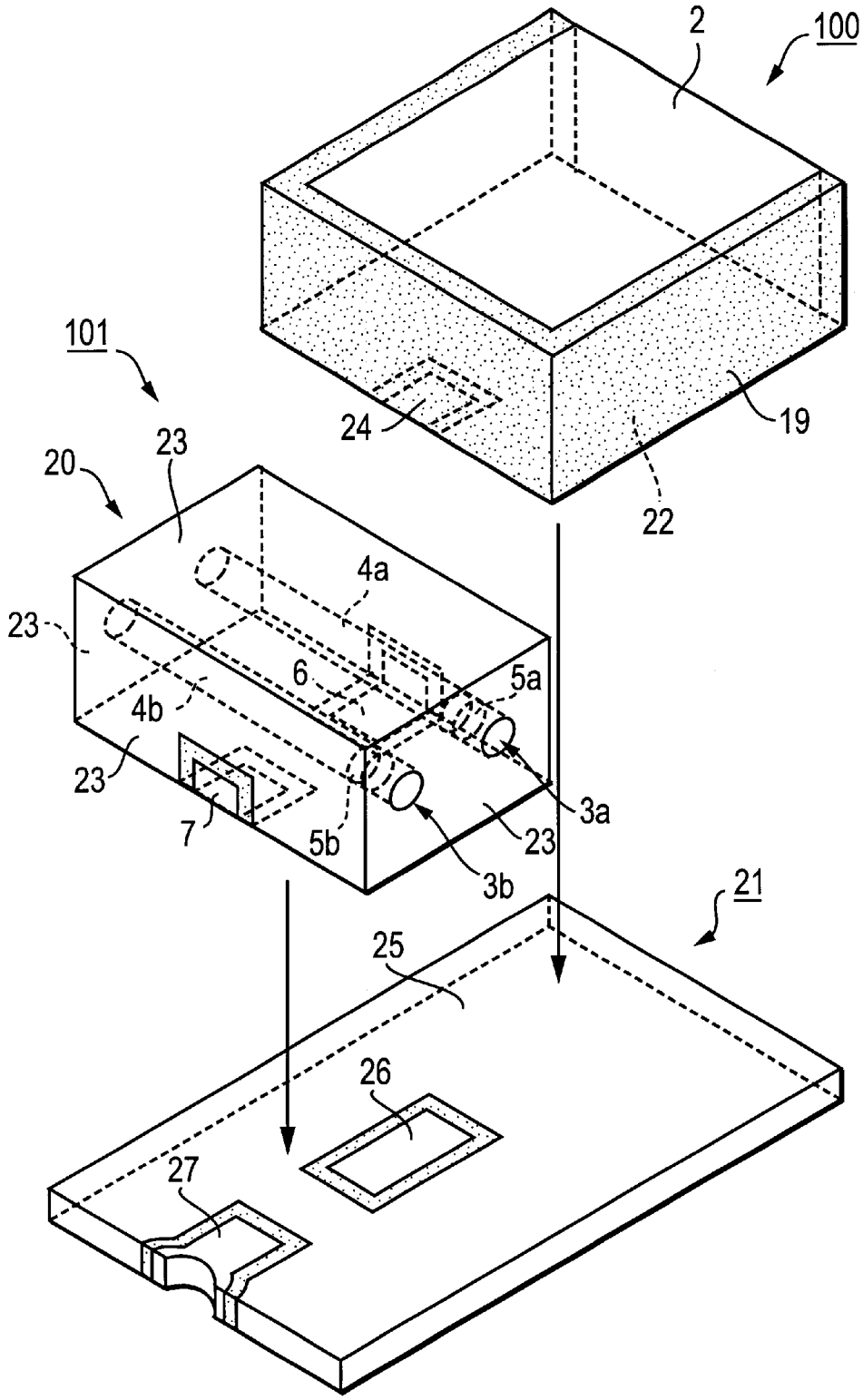
FIG. 5 is an exploded perspective view of a dielectric antenna including a filter according to fourth embodiment.

Next, a constitution of a dielectric antenna including a filter according to a fourth preferred embodiment will be explained with reference to FIG. 5. In FIG. 5, numeral 100 represents an antenna portion. A ground electrode 22 is provided on the bottom face of a dielectric substrate 19 as viewed in the diagram, and a radiation electrode 2 is provided from the end face of the right rear side to the top face as viewed in the diagram. Furthermore, an electrode 24 is provided on the bottom face of the dielectric substrate 19, and is isolated from the ground electrode 22. On the other hand, numeral 101 represents a filter portion, wherein through holes 3*a* and 3*b* are provided in a dielectric substrate 20, and in addition, resonance electrodes 4*a* and 4*b* are provided in the through holes 3*a* and 3*b*.

In FIG. 5, a numeral 21 represents a ceramic substrate, having a ground electrode 25 provided on an outer face thereof. Furthermore, an electrode 26 is provided on the top face in the diagram and is isolated the ground electrode 25. Moreover, an electrode 27 is provided from the top face, via the front end face, to the bottom face, and is isolated from the ground electrode 25. The antenna portion 100 and the filter portion 101 are mounted on this substrate 21 by plating using soldering, a silver electrode, or the like. In this case, the electrodes 6 and 7 of the filter portion 101 lead to the electrodes 26 and 27 on the substrate, the electrode 24 on the antenna portion 100 leads to the electrode 26 on the substrate, and moreover the ground electrodes of the dielectric filter and the dielectric antenna each lead to the ground electrode 25 on the substrate.

The constitution shown above forms a dielectric antenna including a filter using the electrode 27 as an output terminal for received signals.

Figure 6:
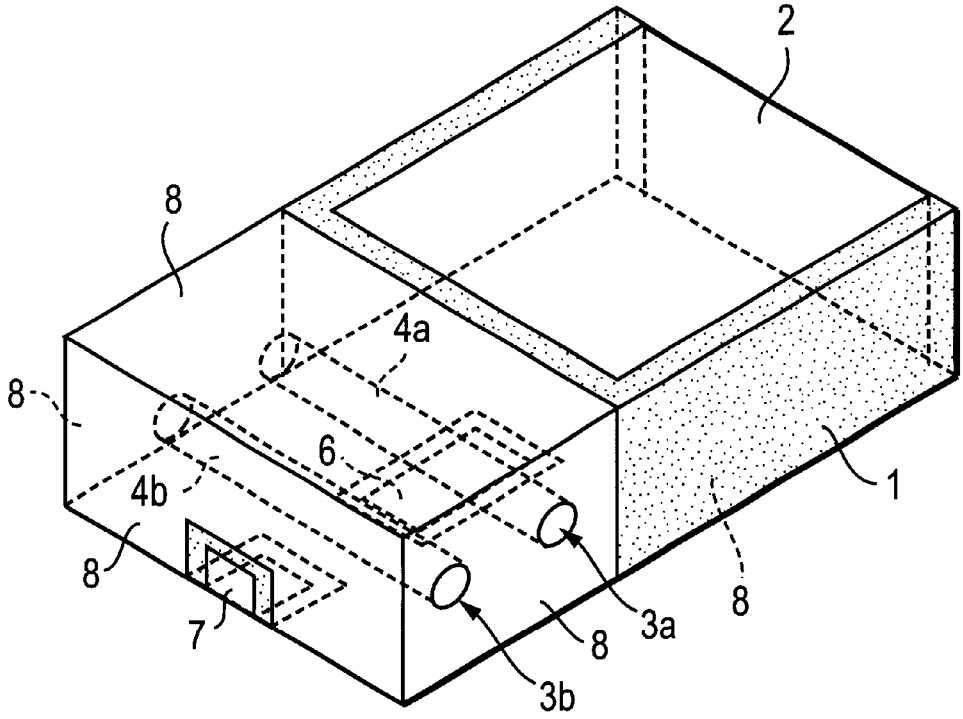
FIG. 6 is a perspective view of a dielectric antenna including a filter according to a fifth embodiment.

FIG. 6 is a perspective view of the dielectric antenna including a filter according to a fifth preferred embodiment. In each of the embodiments shown so far, resonance electrodes were provided inside through holes provided on the dielectric substrate, but the resonance electrodes 4*a* and 4*b* may be provided inside holes 3*a* and 3*b* which do not lead through, as shown in FIG. 6. In this case, a stray capacitance is created between the end portions of the resonance electrodes 4*a* and 4*b* inside the dielectric substrate 1 and the ground electrode 8 on the rear end face as viewed in the diagram. In other respects, the constitution and action are the same as those of the first embodiment.

Figure 7:
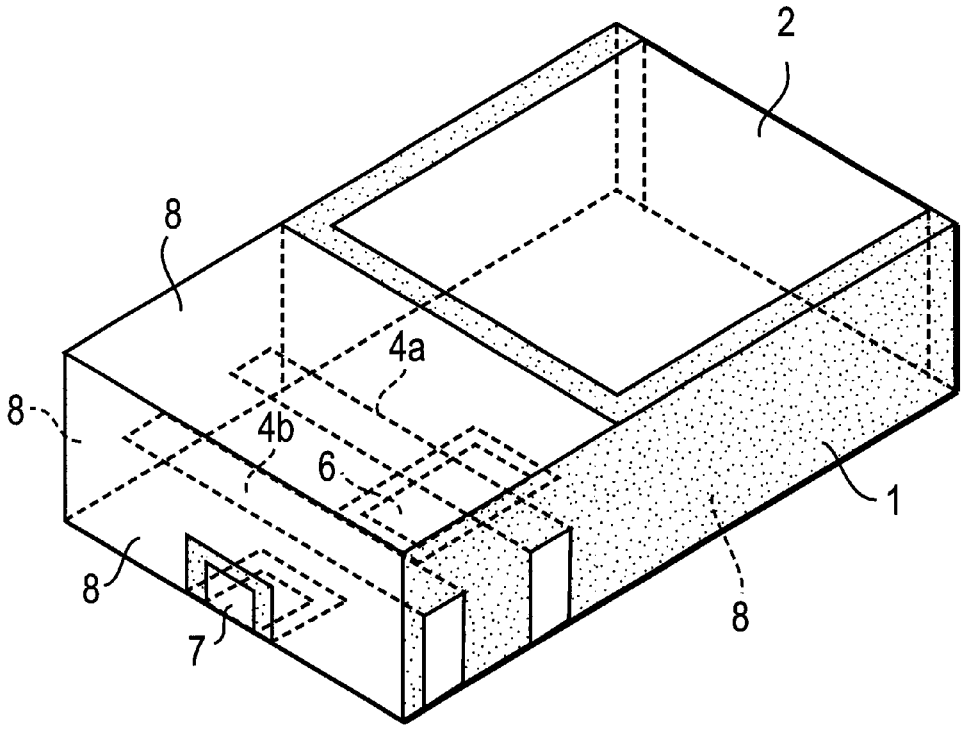
FIG. 7 is a perspective view of a dielectric antenna including a filter according to a sixth embodiment.

FIG. 7 is a perspective view of a dielectric antenna including a filter according to a sixth preferred embodiment. In each of the embodiments shown so far, resonance electrodes were provided inside holes in the dielectric substrate, but as shown in FIG. 7, the resonance electrodes 4*a* and 4*b* may be arranged in a strip-line. Ends of the resonance electrodes 4*a* and 4*b* connect via the front right end face to the ground electrode 8 on the bottom face of the dielectric substrate 1, as viewed in the diagram. The structure and action of the other ends are the same as in the first embodiment.

Next, a constitution of a dielectric antenna including a duplexer will be explained with reference to FIG. 8. Four through holes, represented by 3*a*, 3*b*, 3*c*, and 3*d*, are provided in a rectangular dielectric substrate 1, and resonance electrodes 4*a*, 4*b*, 34*a*, and 34*b*, are provided therein. A ground electrode 8 is provided on the outside faces (six faces) of the dielectric substrate 1, and one end of each of the resonance electrodes 4*a*, 4*b*, 34*a*, and 34*b* connects to the ground electrode 8. Furthermore, the other ends of these resonance electrodes are open at electrode unformed portions 5*a*, 5*b*, 35*a*, and 35*b* where no electrode is formed. An electrode 6 is provided on the bottom face of the dielectric substrate 1 as viewed in the diagram, to create static capacitance between the resonance electrodes 4*a* and 34*b*. Furthermore, electrodes 7 and 37 are provided from the bottom face of the dielectric substrate 1, as viewed in the diagram, to the front left end face, and from the bottom face to the rear right end face. These electrodes 7 and 37 are coupled by static capacitance created between the resonance electrodes 4*b* and 34*a*. A slot 18 is provided on the top face of the dielectric substrate 1 as viewed in the diagram. The electrode 6 provided on the bottom face of the dielectric substrate 1 causes electromagnetic field distribution, whereby an electrical field travels towards the direction of the short end of the slot 18, thereby supplying electricity to the slot antenna.

Figure 8:
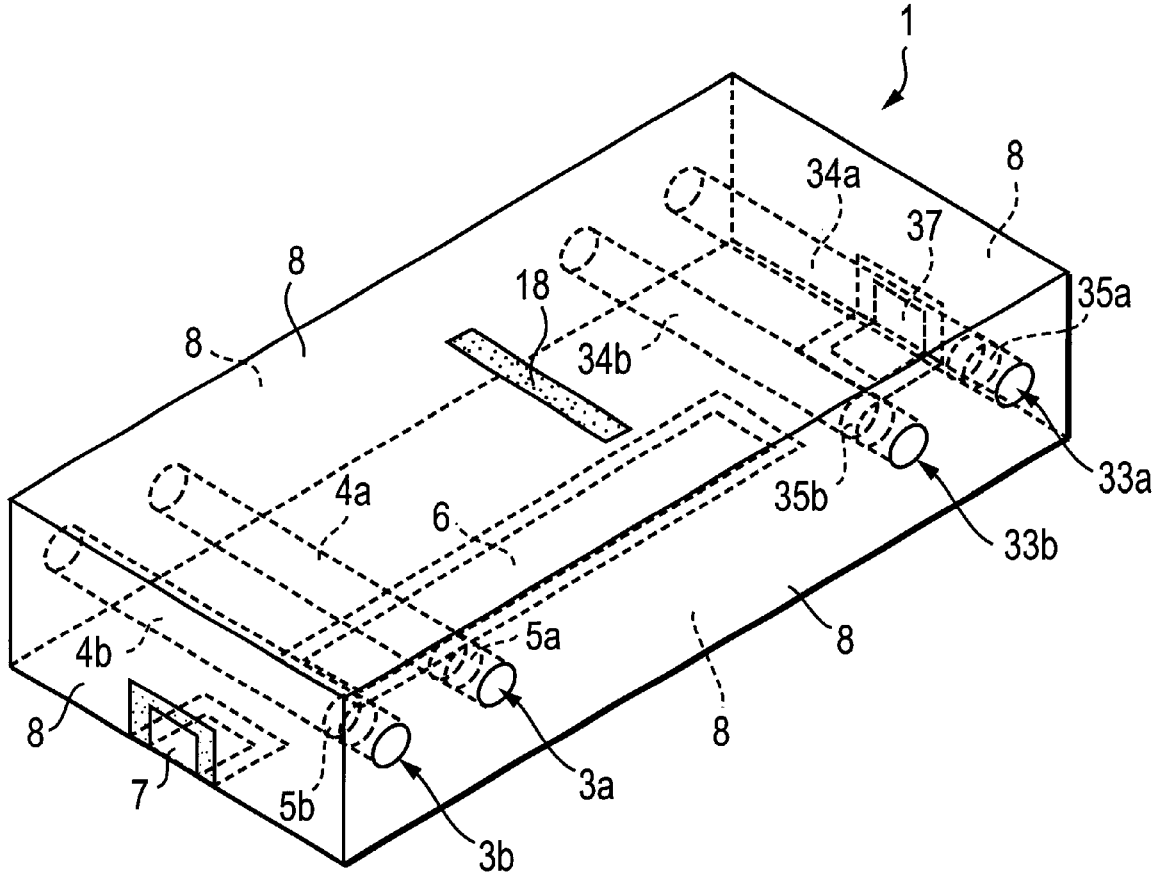
FIG. 8 is a perspective view of a dielectric antenna including a duplexer.

According to the constitution shown in FIG. 8, the reception filter comprises a two-stage resonator using the resonance electrodes 4*a* and 4*b*, and the transmission filter comprises a two-stage resonator using the resonance electrodes 34*a* and 34*b*. Then, the electrode 6 splits the transmitted signal and the received signal. That is, the position of the electrode 6 opposite the slot 18 is the split point, the guide length from the split point to the equivalent short-circuiting face of the input stage resonator (resonator comprising the resonance electrode 4*a*) of the reception filter is an odd multiple of one-quarter of the wavelength of the frequency of the transmitted signal on the guide, and in addition, the guide length from the split point to the equivalent short-circuiting face of the output stage resonator (resonator comprising the resonance electrode 34*b*) of the transmission filter is an odd multiple of one-quarter of the wavelength of the frequency of the received signal on the guide.

Figure 9:
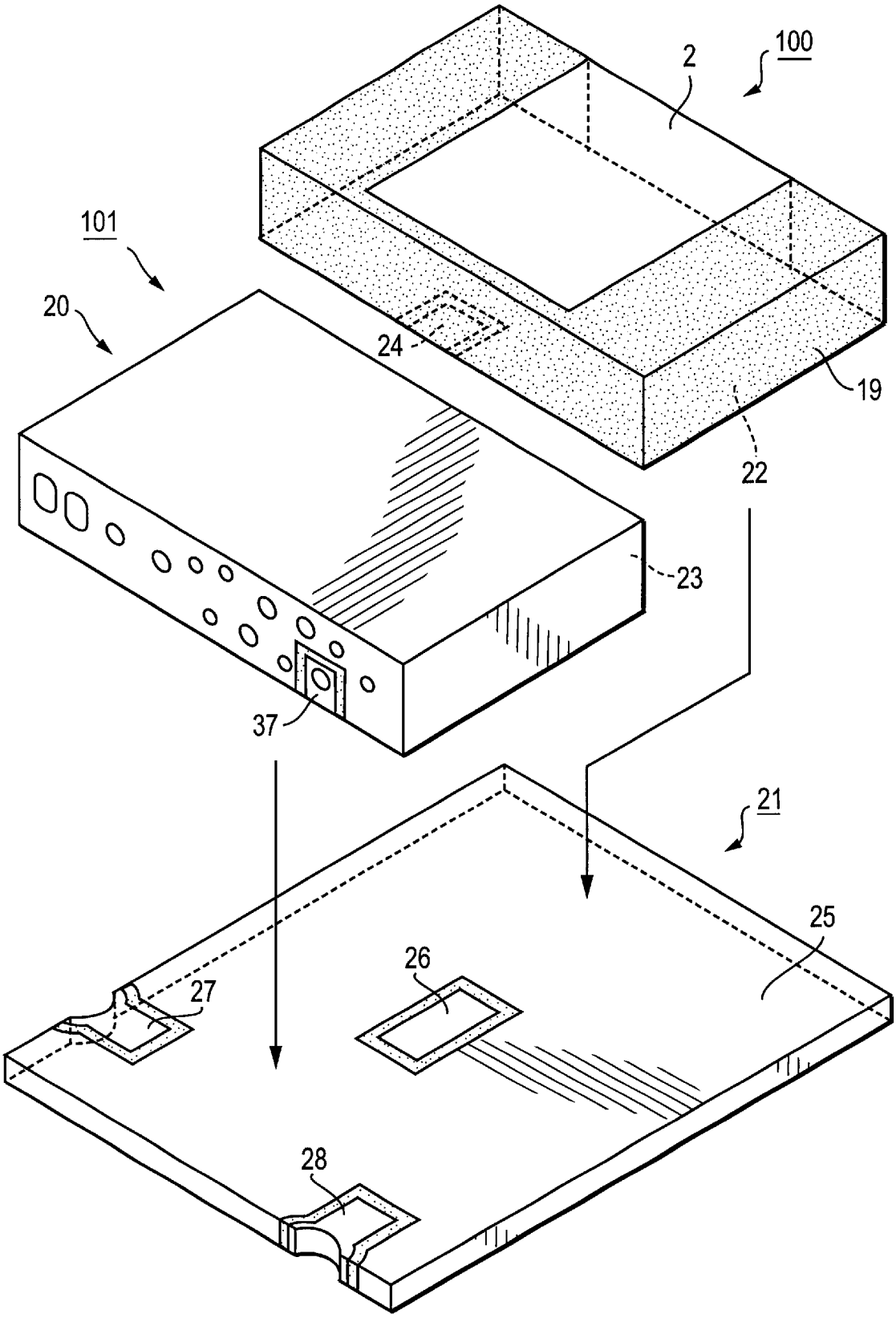
FIG. 9 is an exploded perspective view of another dielectric antenna including a duplexer.

Next, FIG. 9 shows an exploded perspective view of the constitution of another dielectric antenna including a duplexer. In FIG. 9, a numeral 100 represents an antenna portion, a ground electrode 22 is provided on the bottom face of the dielectric substrate 19 as viewed in the diagram, and a radiation electrode 2 is provided from the rear right end face to the top face as viewed in the diagram. Furthermore, an electrode 24 is provided on the bottom face of dielectric substrate 19, and is isolated from the ground electrode 22. On the other hand, a numeral 101 represents a filter portion, having multiple through holes provided in a dielectric substrate 20 and electrodes provided therein.

FIGS. 10A to 10D are projected views of the above filter portion, in which FIG. 10B being a top view, FIG. 10C being a front view, FIG. 10A being a back view, and FIG. 10D being a left side view. This filter portion comprises various types of holes and electrodes provided in a rectangular dielectric block 1. That is, 33*a*, 33*b*, 33*c*, 43*a*, 43*b*, and 43*c* are transmission filter side holes, and 3*a*, 3*b*, 3*c*, and 3*d* are reception filter side holes. Then, a numeral 39 represents a hole for forming an electrode for coupling. As shown in FIG. 10B of the same diagram, the holes are step holes of different diameters at the top half and bottom half of the diagram, and electrodes are provided therein. These electrodes are open at, or near, the ends of the large diameter ends of the step holes. The holes 45*a*, 45*b*, and 45*c*, shown in FIG. 10A, are ground holes. An electrode 38 continuing from an electrode for coupling 40, an electrode for external coupling 37 continuing from a resonance electrode 34*a*, and an electrode for external coupling 7 which creates static capacitance between itself and the resonance electrode 4*d*, are provided on the outer faces of the dielectric substrate. In addition, a ground electrode 23 is provided almost entirely over the faces (six faces) of the dielectric substrate, but avoiding these electrodes.

The action of the filter portion of the constitution described above is as follows. Firstly, the resonator guides 4*a*, 4*b*, 4*c*, and 4*d*, provided in the holes for resonator guide 3*a*, 3*b*, 3*c*, and 3*d*, are comb-line-coupled, and the resonator guide 4*a* is interdigitally coupled to the electrode for coupling 40. As a consequence, the portion between the electrodes 38 and 7 acts as a bandpass filter. On the other hand, the resonance electrodes 34*a*, 34*b*, 34*c*, and 34*d*, provided in the holes 33*a*, 33*b*, and 33*c*, the electrode for coupling 40 and the resonance electrode 34, are interdigitally coupled together. Furthermore, the abovementioned resonance electrodes 34*a*, 34*b*, and 34*c*, and the resonance electrodes, provided in the holes 43*a*, 43*b* and 43*c*, are interdigitally coupled. As a consequence, the electrodes 37 and 38 are each phase-shift coupled by $\pi/2$ via the resonance electrodes 34*a*, 34*b*, and 34*c*, thereby acting as a bandstop filter comprising a three-stage trap circuit. The cut-off action of the ground holes 45*a*, 45*b*, and 45*c* prevents unwanted coupling between the resonance electrodes.

In FIG. 9, a numeral 21 represents a ceramic substrate, having a ground electrode 25 provided on its outer face, and in addition, and electrode 26 is provided on the top face thereof, and electrodes 27 and 28 are provided from the top face, via the side face, to the bottom face. By mounting the antenna portion 100 and the filter portion 101 on the substrate 21, the electrodes 7, 37, and 38 of the filter portion 101 are connected to the electrodes 27, 28, and 26 respectively, and the electrode 24 of the antenna portion 100 is connected to the electrode 26 on the substrate.

In each of the embodiments described above, the resonance electrodes were provided in the dielectric substrate, but it is acceptable to provide the resonance electrodes on the outer face of the dielectric substrate, forming a microstripline resonator.

Next, a radio apparatus using the dielectric antenna including a duplexer will be explained referring to FIG. 11.

FIG. 11 is a block diagram of a transmission portion of a radio apparatus. In the diagram, the alternate long and too short dash line portion represents the dielectric antenna including a duplexer, and the transmission antenna is provided in a single structure with the duplexer. This dielectric antenna including a duplexer is for instance mounted on a circuit substrate in a mobile telephone. Consequently, the entire radio apparatus can be miniaturized.

While the invention has been particularly shown and described with reference to preferred embodiments thereof, it will be understood by those skilled in the art that the foregoing and other changes in form and details may be made therein without departing from the spirit of the invention.

What is claimed is:

1. A dielectric antenna including a filter, comprising:

a dielectric substrate;

an antenna portion comprising; a radiation electrode having one short-circuited end and one open end and provided on a top face of the dielectric substrate;

a filter portion comprising; at least one resonance electrode provided on the dielectric substrate, and a external coupling electrode in association with the resonance electrode;

wherein an electrode electrically isolated from ground is provided on a bottom face opposite to said top face of the dielectric substrate, and the resonance electrode and the radiation electrode are coupled to each other by static capacitances generated respectively between the isolated electrode and the resonance electrode, and between the isolated electrode and the radiation electrode.

2. A dielectric antenna including a filter, comprising a dielectric substrate;

a slot antenna-type antenna portion comprising; a ground electrode opened in a slot shape and provided on a top face of the dielectric substrate;

a filter portion comprising; at least one resonance electrode provided on the dielectric substrate, and a external coupling electrode in association with the resonance electrode;

wherein an electrode electrically isolated from ground is provided on a bottom face opposite to said top face of the dielectric substrate;

a static capacitance is generated between said isolated electrode and said resonance electrode; and an electromagnetic field extends from said isolated electrode to said slot antenna.

3. A radio apparatus comprising the dielectric antenna including a filter according to claim 2, as a high-frequency circuit portion.

4. A dielectric antenna including a filter, comprising:

a first dielectric substrate;

an antenna portion comprising: a predetermined shaped electrode which comprises an external coupling electrode and provided on the first dielectric substrate;

a second dielectric substrate;

a filter portion comprising; at least one resonance electrode provided on the second dielectric substrate, and an external coupling electrode in association with the resonance electrode; and a substrate on which an electrode connecting the external coupling electrode of the antenna portion and the external coupling electrode of the filter portion is disposed, and on which the antenna portion and the filter portion are mounted.

5. A radio apparatus comprising the dielectric antenna including a filter according to claim 4, as a high-frequency circuit portion.

6. A dielectric antenna including a duplexer, comprising:

a dielectric substrate;

an antenna portion comprising; a radiation electrode having one short-circuited end and one open end and provided on a top face of the dielectric substrate;

a transmission filter and a reception filter, each filter comprising: at least one resonance electrode provided on the dielectric substrate, and an external coupling electrode in association with the resonance electrode;

wherein an electrode electrically isolated from ground is provided on a bottom face opposite to said top face of the dielectric substrate;

each resonance electrode and the radiation electrode are coupled to each other by static capacitances generated respectively between the isolated electrode and the resonance electrode, and between the isolated electrode and the radiation electrode; and an output resonance electrode of the transmission filter and an input resonance electrode of the reception filter are both coupled to said radiation electrode of said antenna portion.

7. A radio apparatus comprising the dielectric antenna including a duplexer according to claim 6, as a high frequency circuit portion.

8. A radio apparatus comprising a dielectric antenna including a filter, comprising:

a dielectric substrate, an antenna portion comprising a radiation electrode having one short-circuited end and one open end and provided on a top face of the dielectric substrate;

a filter portion comprising; at least one resonance electrode provided on the dielectric substrate and a external coupling electrode in association with the resonance electrode;

wherein an electrode electrically isolated from ground is provided on a bottom face opposite to said top face of the dielectric substrate; and the resonance electrode and the radiation electrode are coupled to each other by static capacitances generated respectively between the isolated electrode and the resonance electrode, and between the isolated electrode and the radiation electrode; and a high-frequency circuit portion connected to said external coupling electrode.

9. A dielectric antenna including a duplexer, comprising:

a dielectric substrate;

a slot antenna-type antenna portion comprising; a ground electrode opened in a slot shape and provided on a top face of the dielectric substrate;

a transmission filter and a reception filter each filter comprising: at least one resonance electrode provided on the dielectric substrate and an external coupling electrode in association with the resonance electrode;

wherein an electrode electrically isolated from ground is provided on a bottom face opposite to said top face of the dielectric substrate;

a static capacitance is generated between said isolated electrode and a resonance electrode of each said filter;

an electromagnetic field extends from said isolated electrode to said slot antenna;

whereby a resonance electrode of the transmission filter and a resonance electrode of the reception filter are both coupled to said antenna portion.

10. A dielectric antenna including a duplexer, comprising:

a first dielectric substrate;

an antenna portion comprising: a predetermined shaped electrode which comprises an external coupling electrode and provided on the first dielectric substrate;

a second dielectric substrate;

a transmission filter and a reception filter, each filter comprising: at least one resonance electrode provided on the second dielectric substrate, and an external coupling electrode in association with the resonance electrode; and a substrate on which an electrode connecting the external coupling electrode of the antenna portion and the external coupling electrode of the filter portion is disposed, and on which the antenna portion and the filter portion are mounted;

an output resonance electrode of the transmission filter and an input resonance electrode of the reception filter both being coupled to said antenna portion.

11. A radio apparatus comprising a dielectric antenna including a duplexer, comprising:

a dielectric substrate;

an antenna portion comprising a radiation electrode having one short-circuited end and one open end and provided on a top face of the dielectric substrate;

a transmission filter and a reception filter, each filter comprising: at least one resonance electrode provided on the dielectric substrate, and an external coupling electrode in association with the resonance electrode;

wherein an electrode electrically isolated from ground is provided on a bottom face opposite to said top face of the dielectric substrate; and a resonance electrode of each said filter and the radiation electrode are coupled to each other by static capacitances generated respectively between the isolated electrode and the resonance electrodes, and between the isolated electrode and the radiation electrode;

whereby a resonance electrode of the transmission filter and a resonance electrode of the reception filter are both coupled to said radiation electrode of said antenna portion; and a high-frequency circuit portion connected to said external coupling electrode of at least one of said transmission filter and said reception filter.

12. A radio apparatus comprising a dielectric antenna including a filter, comprising:

a dielectric substrate;

a slot-antenna-type antenna portion comprising a ground electrode with a slot-shaped opening provided on a top face of the dielectric substrate;

a filter portion comprising at least one resonance electrode provided on the dielectric substrate, and an external coupling electrode in association with the resonance electrode;

wherein an electrode electrically isolated from ground is provided on a bottom face opposite to said top face of the dielectric substrate; a static capacitance is generated between the isolated electrode and the resonance electrode; and an electromagnetic field extends from said isolated electrode to said slot antenna; and a high-frequency circuit portion connected to said external coupling electrode.

13. A radio apparatus comprising a dielectric antenna including a filter, comprising:

a first dielectric substrate;

an antenna portion comprising: a predetermined shaped electrode and an external coupling electrode, provided on the first dielectric substrate;

a second dielectric substrate;

a filter portion comprising: at least one resonance electrode provided on the dielectric substrate, and an external coupling electrode in association with the resonance electrode;

a substrate on which is disposed an electrode connecting the external coupling electrode of the antenna portion and the external coupling electrode of the filter portion; and on which the antenna portion and filter portion are mounted; and a high-frequency circuit portion connected to a second external coupling electrode associated with said resonance electrode.

14. A radio apparatus comprising a dielectric antenna including a duplexer, comprising:

a dielectric substrate;

a slot antenna-type antenna portion comprising; a ground electrode opened in a slot shape and provided on a top face of the dielectric substrate;

a transmission filter and a reception filter, each filter comprising: at least one resonance electrode provided on the dielectric substrate, and an external coupling electrode in association with the resonance electrode;

wherein an electrode electrically isolated from ground is provided on a bottom face opposite to said top face of the dielectric substrate;

a static capacitance is generated between said isolated electrode and a resonance electrode of each said filter;

an electromagnetic field extends from said isolated electrode to said slot antenna;

whereby a resonance electrode of the transmission filter and a resonance electrode of the reception filter are both coupled to said antenna portion; and a high-frequency circuit portion coupled to said external coupling electrode of at least one of said transmission filter and said reception filter.

15. A radio apparatus comprising a dielectric antenna including a duplexer, comprising:

a first dielectric substrate;

an antenna portion comprising: a predetermined shaped electrode and an external coupling electrode, provided on the first dielectric substrate;

a second dielectric substrate;

a transmission filter and a reception filter, each filter comprising: at least one resonance electrode provided on the second dielectric substrate, and an external coupling electrode in association with the resonance electrode;

a substrate on which an electrode connecting the external coupling electrode of the antenna portion and the external coupling electrode of the filter portion is disposed, and on which the antenna portion and the filter portion are mounted;

whereby a resonance electrode of the transmission filter and a resonance electrode of the reception filter are both coupled to said antenna portion; and a high-frequency circuit portion coupled to at least one of said transmission filter and said reception filter.

* * * * *